US007542379B2

(12) United States Patent
Kimel et al.

(10) Patent No.: US 7,542,379 B2
(45) Date of Patent: Jun. 2, 2009

(54) MOBILE MEDICATION

(75) Inventors: Janna C. Kimel, Portland, OR (US); Kofi Cobbinah, Houston, TX (US); Betty Eng, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 11/644,016

(22) Filed: Dec. 22, 2006

(65) Prior Publication Data

US 2008/0151695 A1 Jun. 26, 2008

(51) Int. Cl.
*G04B 47/00* (2006.01)

(52) U.S. Cl. ..... 368/10; 224/165

(58) Field of Classification Search ..... 224/163, 224/165, 170

See application file for complete search history.

(56) References Cited

U.S. PATENT DOCUMENTS 5,181,189 A * 1/1993 Hafner ..... 368/10
5,802,014 A * 9/1998 Danko ..... 368/10
5,915,558 A * 6/1999 Girvetz ..... 368/10
6,259,654 B1 * 7/2001 De la Huerga ..... 368/10
6,560,165 B1 * 5/2003 Barker ..... 368/10
2003/0086338 A1 * 5/2003 Sastry et al. ..... 368/10
2005/0163047 A1 * 7/2005 McGregor et al. ..... 370/229

* cited by examiner

*Primary Examiner*—Renee Luebke
*Assistant Examiner*—Jason Collins
(74) *Attorney, Agent, or Firm*—Pillsbury Winthrop Shaw Pittman LLP

(57) ABSTRACT

A mobile medication device including a timekeeping unit, which may be a wrist watch and may include a microprocessor, to track a plurality of time events associated with a plurality of medications to given to a user, wherein the time events may be specific times at which a particular medication is to be taken by the user, and may also include additional events such as a predetermined time prior to when the user is supposed to take a medication.

28 Claims, 5 Drawing Sheets

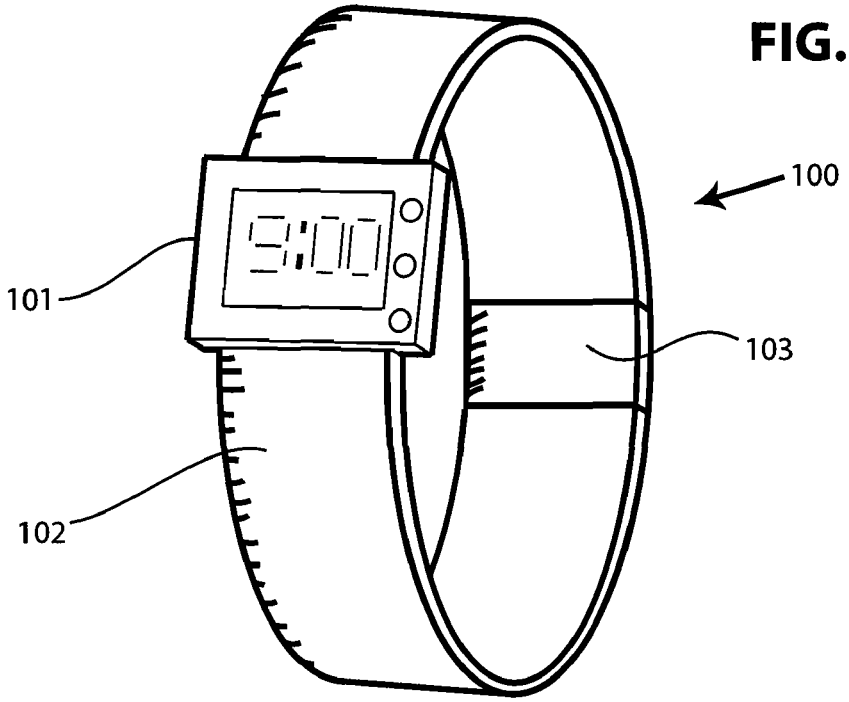
FIG. 1
FIG. 2
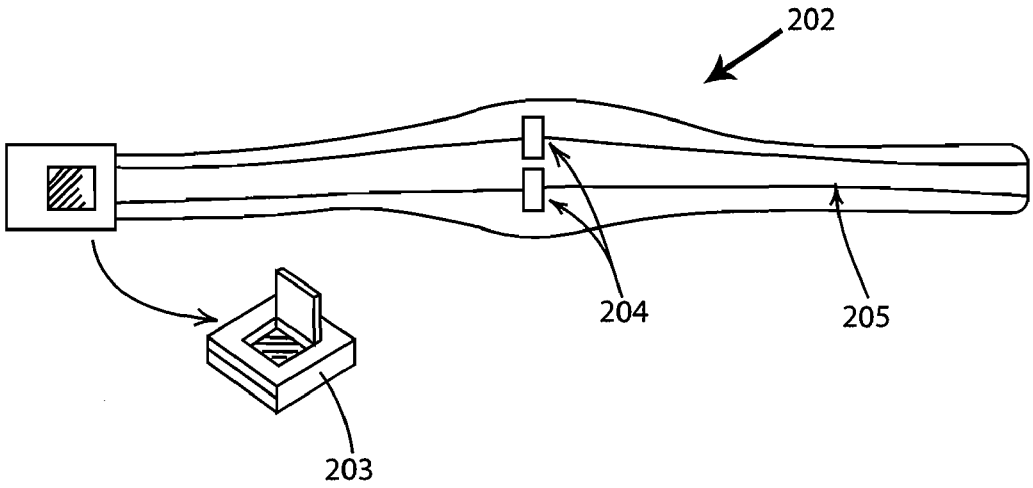

MOBILE MEDICATION

FIELD OF THE INVENTION

The invention is in the field of mobile medication systems.

BACKGROUND OF THE INVENTION

In today's society, a large percentage of the population depends on mediation s to enjoy enhanced levels of health and activity. Most individuals receive this medication in bottles, blister packs, or in daily dose packs., These different collections of medications may be received from a pharmacy, over the internet or even over the counter. Many medications require a prescription to receive.

Patients often create systems to remind themselves when to take their medications and, for many patients, which medications to take. Patients often use aids such as 7 day medication reminder boxes to help keep track of their medications. Most of these reminder systems are set up for in home use. Accordingly, when a patient is away from their home, the patient is more prone to forget to take their medication properly. Furthermore, patient's who leave their homes commonly wrap pills in tissues or simply put their pills in an available pocket or baggie. Some patients try to set their watch alarms to remind them to take their medications, however these alarms go off regardless of whether the medication has been taken and can only be set to go off at one particular time.

BRIEF SUMMARY OF THE INVENTION

According to various embodiments of the invention, a mobile medication device may include a timekeeping unit to track a plurality of time events associated with a plurality of medications to be given to a user, and to alert the user based on the time events; and a band to removably attach the timekeeping unit to the user, wherein the band comprises a plurality of compartments to transport the medications.

According to various embodiments of the invention, a mobile medication device may further include a medication tracking unit to track the medications being transported in the compartments.

According to various embodiments of the invention, the plurality of time events comprise medication events associated with associated medications to indicate times at which the user is to be given the associated medications, wherein the associated medications are some or all of the medications that are associated with the medication events.

According to various embodiments of the invention, the plurality of time events further comprise pre-medication events associated with the medication events to alert the user that the medication events of the associated medications are approaching.

According to various embodiments of the invention, the plurality of time events further comprise post-medication events, associated with the medication events, to alert the user that the associated medication events have passed.

According to various embodiments of the invention, the medication tracking unit is configured to determine that at least one of the medications is no longer being transported.

According to various embodiments of the invention, the compartments comprise blister packs and wherein the medication tracking unit is configured to determine that at least one of the medications is no longer being transported due to a change in a conductivity of the associated blister pack.

According to various embodiments of the invention, at least one of the compartments comprises a locking unit to prevent the compartment from being opened, wherein the locking unit is configured to be disabled when a time event associated with the compartment occurs.

According to various embodiments of the invention, the time event associated with the compartment is a medication event.

According to various embodiments of the invention, the timekeeping unit comprises a display to indicate which of the plurality of medications is to be given to the user based upon at least one of the time events.

According to various embodiments of the invention, a mobile medication device may further include an audio alert device configured to emit an audio signal when a predetermined time event has occurred.

According to various embodiments of the invention, the audio signal indicates which of the medications are to be given.

According to various embodiments of the invention, a mobile medication device may further include a visual alert device configured to emit a visibly detectable signal when a predetermined time event has occurred.

According to various embodiments of the invention, a mobile medication device may further include a visual alert device configured to emit a visibly detectable signal when a predetermined time event has occurred.

According to various embodiments of the invention, a mobile medication device may further include a plurality of visual alert devices associated with the plurality of compartments and configured to emit a visibly detectable signal when a predetermined time event has occurred.

According to various embodiments of the invention, the visibly detectable signals are configured to illuminate the compartments associated with the time events.

According to various embodiments of the invention, a mobile medication device may further include a motion based alert device configured to cause the device to vibrate when a predetermined time event has occurred.

According to various embodiments of the invention, the timekeeping unit comprises a memory.

According to various embodiments of the invention, timekeeping unit is configured to be programmed using an external computer.

According to various embodiments of the invention, the external computer transmits data to the timekeeping using Bluetooth technology.

According to various embodiments of the invention, a mobile medication device may further include a biofeedback unit to measure at least one of the user's pulse, blood pressure, temperature and pulse oxygen level.

According to various embodiments of the invention, a mobile medication device may further include a transmitter to transmit data to an external processor.

According to various embodiments of the invention, a mobile medication device may further include a geo-locator unit to determine a relative position of the device.

According to various embodiments of the invention, the geo-locator unit comprises a GPS device.

According to various embodiments of the invention, the geo-locator unit utilizes RSSI.

According to various embodiments of the invention, the display is configured to display images associated with the medications to be given.

According to various embodiments of the invention, a method may include tracking a plurality of time events associated with when a user is to be given a plurality of medications on a event-keeping device; alerting the user when a time event occurs such that the user is informed that a time to be given one of the plurality of medications has arrived; and indicating which of the plurality of medications is to be given to the user, wherein at least one of the plurality of medications is encapsulated in a band which is attached to the event-keeping device, wherein the band is configured to be removably attached to the user.

According to various embodiments of the invention, the alerting the user comprises utilizing at least one of an audio signal, a visual signal or a movement alert.

According to various embodiments of the invention, the event-keeping device is a watch and the band is a watch band.

According to various embodiments of the invention, the band is removably attached to the event-keeping device.

According to various embodiments of the invention, the band comprises a plurality of compartments.

According to various embodiments of the invention, the band comprises a blister pack.

According to various embodiments of the invention, a method may further include transmitting data associated with the time events to an external processor.

According to various embodiments of the invention, a method may further include receiving data associated with the time events from an external processor.

According to various embodiments of the invention, a medication reminder system, may include a mobile medication device, comprising: a timekeeping unit to track a plurality of time events associated with a plurality of medications to be given to the user, and to alert the user based on the time events; and a band to removably attach the timekeeping unit to the user, wherein the band comprises a plurality of compartments to transport the medications; and an external microprocessor device to transfer data to and from the timekeeping unit.

According to various embodiments of the invention, at least one prescription associated with at least one of the medications is stored in the memory.

BRIEF DESCRIPTION OF THE DRAWINGS

FIG. 1 depicts a first exemplary mobile medication device in accordance with various embodiments of the invention.

FIG. 2 depicts a band of an exemplary mobile medication device in accordance with various embodiments of the invention.

DETAILED DESCRIPTION OF THE INVENTION

Figure 3:
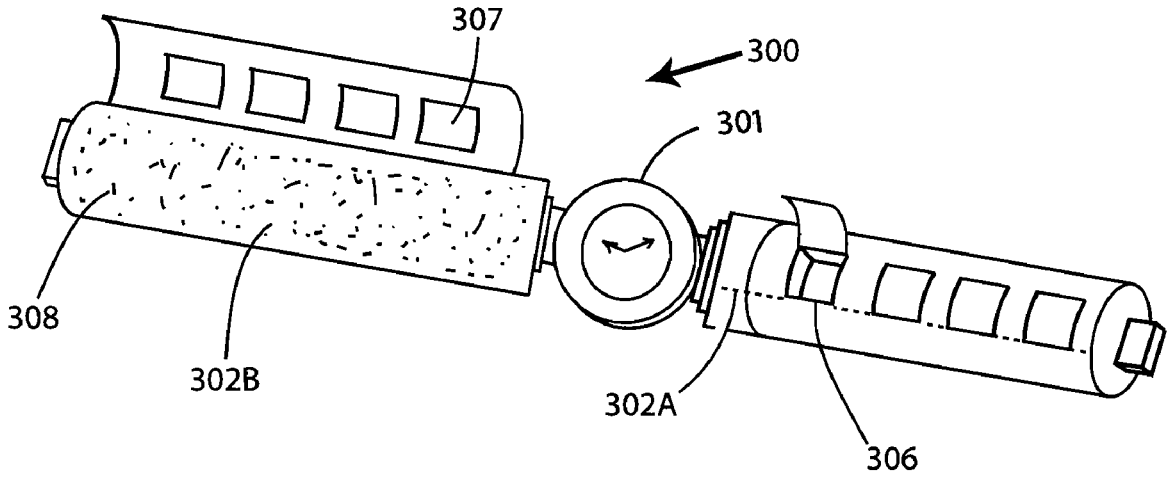
FIG. 3 depicts a second exemplary mobile medication device in accordance with various embodiments of the invention.

According to various embodiments of the invention, a mobile medication device may include a timekeeping unit to track a plurality of time events associated with a plurality of medications to be ingested by, or given to, the user. The timekeeping device may be a wrist watch, or, according to other embodiments, the timekeeping device may include a more sophisticated microprocessor. The time events may be specific times at which a particular medication is to be taken by a patient, and they may also include additional events such as a predetermined time prior to when a patient is supposed to take a medication. A time event may also be a time, or series of times, following a time at which a medication is to be taken.

According to a further embodiment, a time event may be a time at which a medication was taken. Time events are not limited to the given examples thereof.

According to various embodiments of the invention, the timekeeping device may be used to alert a user based on the time events. The alert may be a simple alarm to let the user know that it is time to take a medication, or that the time to take the medication is approaching, or that it has passed. Additionally, the alert may inform the user as to which medication is to be taken. This may be done by indicating the type of medication on a display, by emitting a sound, such as a customized tone, which is associated with the medication or, according to a further embodiment, the alert may emit a speech based signal which tells the user which medication to take.

According to further embodiments, the device may use a progressive alert system to help assure the user's privacy. A progressive alert system may start with a less intrusive alarm and may progress to a more intrusive alarm. For example, a device may emit a vibration prior to the time a medication is to be taken, for example, the device may begin to vibrate five minutes prior the time at which a medication is to be taken. The vibration signal may be intermittent or continuous, or it may only be emitted for a predetermined period of time. If the device does not detect that the medication has been taken by the time the medication should be taken, or in other embodiments, if the user has not provided an input to indicate that the medication has been taken, an audible alarm, such as a single beep may be emitted. The device may then wait a predetermined time, and if there is no indication that the medication has been taken, the device may emit a louder or more persistent audible alert. If the device still does not receive an indication that the medication has been taken following a further predetermined period, a visual alert, such as a flashing light, or a constant audible alert may be emitted.

In further embodiments, the device may be connected to a network, such as a computer network or a cellular network, and further alerts may be transmitted to other devices and/or people by utilizing the networks. For example, if a constant audible signal persists for a given period of time, the device may cause an e-mail or voice message to be sent to a predetermined person's email account or cell phone. In another embodiment, a signal or message may be sent to an emergency response system.

According to various embodiments of the invention, a mobile medication device may also include a band, such as a watch band, to secure the device to the user. The band may include several compartments in which medication may be stored. The compartments may be portions of a blister pack which is secured in the band, or which, in the alternative, may make up a disposable band. According to other embodiments, the compartments may be small containers, such as boxes, into which medication may be inserted and secured, for example, via a hinged or sliding door.

According to various embodiments of the invention which use compartments having doors, the device may include a locking device to prevent the doors from being opened until an associated time event occurs, at which point the locking device may be disengaged. This feature may prevent a user from taking the wrong medications, or from taking medications at a time other than a predetermined time. Additional embodiments may have an override capability to disable the locking devices.

According to various embodiments of the invention, the timekeeping device may be able to detect when medication is removed from one of the compartments. The device may determine such an event, which may be tracked as a time event, based on a change in resistance associated with at least a portion of the band, by the opening of a closed circuit, by a change in light or even by using additional detecting devices such as a light meter or an accelerometer.

According to various embodiments of the invention, the device may use a separate medication tracking unit to track the medications being transported in the compartments. This unit may record which medications are located in which compartments, as well as when the medications were put into the compartments and/or when they were removed. The unit may also record information related to any prescriptions the user may have, such information may include a digital representation of a prescription that may be suitable to conform with laws regarding the transporting of prescription medications not in a prescription bottle.

According to various embodiments of the invention, the device may include a device to assist a user in determining which compartment contains medications to be taken at a specific time. Such a device may include a series of light emitting devices, such as LED's, which may be associated with the compartments. In such a device, when it is time for a user to take a certain medication, the compartment in which the medication is located is illuminated by at least one light emitting device such that the user can easily determine which compartment should be accessed. In some embodiments, the light emitting devices may be associated with time events.

According to various embodiments of the invention, the device may further include a memory unit such as a flash memory to record additional information related to time events, a user's medical history and/or records, a user's address, or additional user related information.

According to various aspects of the invention, an Electrically Erasable Programmable Read-Only Memory (hereinafter, "EEPROM") may be included in the device as a nonvolatile storage chip. EEPROMs typically come in a range of capacities from a few bytes to over 128 kilobytes and are often used to store configuration parameters. In some systems, EEPROMs have been used in lieu of CMOS nonvolatile BIOS memory. For example, in personal computers EEPROMs are often used to store the BIOS code and related system settings. EEPROMs may be erased electrically in-circuit, and may be used for 100,000 erase-write cycles or more. EEPROMs typically retain data when power is not supplied. EEPROM chips may use serial interfaces to connect to other devices.

According to various embodiments of the invention, the device, and or the timekeeping unit may be configured to be programmed using an external computer or other processor. The device may be connected to the computer using a hardwired system or a wireless system. Such wired or wireless communication of data and/or voice may include, but are not limited to, the following: 802.11 wireless network protocol; Bluetooth protocol; 802.15.4 protocol; wired network protocol; telephone line; infrared data transfer; acoustic coupler; RS-232 serial transfer; manual transfer via memory card, Near Field Communication or RFID.

The heart of an RFID system lies in an information carrying tag called an RFID tag, which functions in response to a coded RF signal received from a base station or an RFID reader. Typically, an RFID tag reflects an incident RF carrier back to the base station or reader, and information is transferred as the reflected signal is modulated by the RFID tag according to its programmed information protocol.

Generally an RFID tag has a semiconductor chip having RF circuits, various logic circuitry, and a memory, as well as an antenna, a collection of discrete components, such as capacitors and diodes, a substrate for mounting the components, interconnections between components, and a physical enclosure. Two types of RFID tags are generally used, active tags, which utilize batteries, and passive tags, which are either inductively powered or powered by RF signals used to interrogate the tags; passive tags do not use a battery.

Generally, passive RF tags contain of two basic parts: an analog circuit which detects and decodes the RF signal and provides power to a digital portion of the tag using RF field strength from the reader, and a digital circuit which implements multiple items of tag identification protocol.

A radio frequency (RF) identification system generally consists of an RF reader and a plurality of RF tags. In a typical configuration, the reader utilizes a processor which issues commands to an RF transmitter and receives commands from the RF receiver. The commands serve to identify tags present in the RF field.

In some implementations, commands exist to gather information from the tags. In more advanced systems, commands exist which output information to the tags. This output information may be held temporarily on the tag, it may remain until written over, or it may remain permanently on the tag.

The RF transmitter of the reader generally encodes commands from the processor, modulates the commands from a base band to the radio frequency, amplifies the commands, and then passes the commands to the RF antenna. The RF receiver receives the signal at an antenna, demodulates the signal from the RF frequency to the base band, decodes the signal, and passes it back to the processor for processing. The reader's antenna is usually capable of transferring RF signals to and from a plurality of tags within the RF signal range.

Radio Frequency Identification is a type of automatic identification method, which utilizes storing and remotely retrieving data using devices called RFID tags or transponders. Chip-based RFID tags generally contain silicon chips and antennas. Passive tags generally do not use an internal power source, whereas active tags generally do incorporate a power source. RFID cards, also known as "proximity" or "proxy" cards, come in three general varieties: passive, semi-passive (also known as semi-active) and active.

Passive RFID tags generally have no internal power supply. A minute electrical current induced in an antenna by incoming radio frequency signals generally provide enough power for an integrated circuit (hereinafter, "IC"), e.g. a CMOS based IC, in the tag to power up and transmit a response. Most passive tags provide a signal by backscattering the carrier signal received from an RFID reader. In order to utilize backscattering, the antenna of a passive RFIC tag is generally configured to collect power from the incoming signal and to transmit an outbound backscatter signal. The response of a passive RFID tag is not limited to an ID number (e.g. GUID); many RFID tags contain nonvolatile memory devices, such as EEPROMs, for storing data. Common passive RFID tags may commonly be read at distances ranging from about 10 cm to a several meters, depending on the chosen radio frequency and antenna design/size.

Unlike passive RFID tags, active RFID tags generally have internal power sources which are used to power incorporated ICs that generate an outgoing signal. Active tags may be more reliable (e.g. fewer errors) than passive tags because the active tags may conduct a session with a reader where error correction and/or signal verification may be utilized. Active tags may also transmit at higher power levels than passive tags, allowing them to be more effective in "RF challenged" environments such as water or metal, and over greater distances. Many active RFID tags have practical ranges of hundreds of meters, and a battery life of up to 10 years.

In a typical RFID system, an RFID reader may be contain an antenna packaged with a transceiver and decoder. The RFID reader may emit a signal activating the RFID tag so it can read data from and write data to the RFID tag. When an RFID tag passes through the electromagnetic zone, it detects the reader's activation signal and is activated. The reader may then decode the data encoded in the tag's IC and may either store the data of pass the data to a processor.

Depending on the type of system utilizing the RFID reader, application software on a host computer may process the data in a myriad of different ways, e.g. the data may be filtered to reduce redundant readings of the same tag and to form a smaller and more useful data set.

Near Field Communication (hereinafter, "NFC") is a new, short-range wireless connectivity technology that evolved from a combination of existing contact free identification and interconnection technologies. Products with built-in NFC may simplify the way consumer devices interact with one another, helping speed connections, receive and share information and even making fast and secure payments.

Commonly operating at 13.56 MHz and transferring data at up to 424 Kbits/second, NFC provides intuitive, simple, and safe communication between electronic devices. NFC is both a "read" and "write" technology. Communication between two NFC-compatible devices may occur when the devices are brought within approximately four centimeters of one another: a simple wave or touch may establish an NFC connection which is then compatible with other known wireless technologies such as Bluetooth or Wi-Fi. Because the transmission range may be relatively short, NFC-enabled transactions are inherently secure. Also, physical proximity of the device to the reader gives users the reassurance of being in control of the process.

NFC may be used with a variety of devices, from mobile phones that enable payment or transfer information to digital cameras that send their photos to a TV set with just a touch.

According to various embodiments of the invention, the device may utilize a transceiver to transmit and/or receive information. Typically, a transceiver is a device that has a transmitter and a receiver which may be combined. Technically, transceivers generally combine a significant amount of the transmitter and receiver handling circuitry. Similar devices may include transponders, transverters, and repeaters. Generally, a transceiver combines both transmission and reception capabilities within a single housing. The term transceiver, as used herein may refer to a device, such as an RFID tag or an NFC device. These devices may receive data over a hardwired connection or a radio frequency connection, as well as through various other types of connection. The devices may transmit information over similar of different connections.

According to various embodiments of the invention, the device may utilize a system based on Received Signal Strength Indicator (hereinafter, "RSSI") technology to determine a location of the device. RSSI is a known term in the field of radio engineering, and is a common feature designed in most radio transceivers systems. In a common dielectric medium, the emission of the radio waves from transmitters the RSSI is known to decay as a power function as the distance between the transmitter and receiver are increased. In the device and method describe wherein the medium is known to be a discontinuous dielectric thereby reducing the decay of the RSSI to a near liner function of the distance between the receiver and transmitter increases.

According to various embodiments of the invention, such a system may be used to determine a location of the device in a house. Using these capabilities, the device may be configured to infer whether the user is in the home, such that time events may be configured to use a set of location based protocols, or out of the home, where prompts can be driven to the mobile system described above. The device may be configured to use protocols which determine whether a user is moving from one place to another or if the user is stationary for a set period of time, and then to use protocols based on the determination. For example, if the user is in motion, the device may not instruct the user to take medications under an assumption that the medications may be harder to take in a vehicle. Accordingly, the device may wait until the user appears to have stopped traveling to alert the user that it is time to take the medication. Such protocols may take into account the importance of taking each medication at a specific time such that it may delay alerts for those medications that may be taken during a broad time window, while the device may not delay alerts for medications which must be taken in more narrow time windows.

When outside the home, FM signals may be used to determine whether the user is moving quickly from one location to the other, thereby implying travel in a bus, train or car. If the user appears to be staying in one general area, the device could be set to alert the user assuming a more set location for a period of time which may be more conducive to taking the medication.

Existing indoor location tracking techniques rely on the RSSI of two or more receivers. This is an issue in Bluetooth-based location tracking because the device that is the Bluetooth master can connect to at most eight slaves in a pico-net, dictating that each device that wishes to contribute an RSSI value is a slave to a mobile master such as the device of the invention. In that case, other devices can not communicate with the master to save data. According to an embodiment of the invention, the mobile device is used as a slave in the network rather than a master. While this solves the problems of having a mobile master, it restricts the number of masters that can speak to the mobile device to one, which would normally produce too few RSSI signals to locate the mobile device. In contrast, according to an embodiment of the invention, a single master's RSSI and radio Link Quality measures are used to locate the mobile device within the house.

Figure 5:
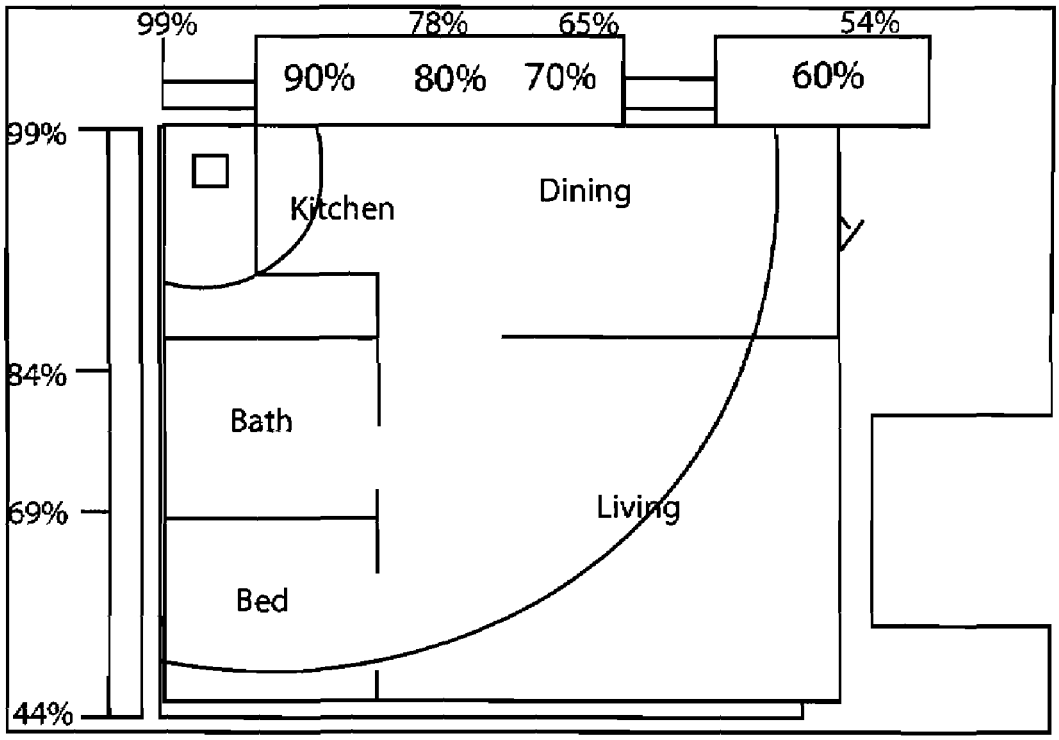
FIG. 5 depicts an exemplary floor plan showing relative RSSI measurements in accordance with various embodiments of the invention.
Figure 5:
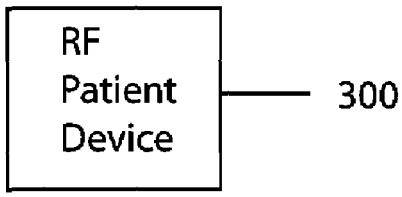

FIG. 5 shows an apartment floor plan, a device 10 in the upper-left corner of the apartment, with an idealized map of RSSI values based on the location of the patient's RF device within the apartment. Each dark arc represents a line of equal RSSI, and the scale along the top of the figure shows the RSSI value corresponding to each line. For example, if the patient and their associated radio device (RF patient device 300) are in the living area, the RSSI signal measured by the base station in the kitchen would by approximately 60%.

In FIG. 5, the Bluetooth Master (device 10) may infer from its 60% RSSI value that the patient (actually, the patient's radio device) may be in the bedroom, living room or the dinning area—RSSI alone is not sufficient to determine the location of the mobile device within the apartment. In most instances, due to radio signal reflections, absorption, and multi-path interference caused by the walls and furniture in the apartment, the RSSI map will be much more complex. Even in the case of a complex RSSI map of the apartment, areas of equal RSSI (and therefore ambiguous location) exist.

In one embodiment, a base station radio uses RSSI and Link Quality to infer the location of the patient's radio device. In a home, there are various points in which a radio signal is bounced, or partially blocked. These locations are unique to a home and position of the devices, and home construction, and furnishings. As such, the LQ (Link Quality; also called BER, the bit error rate), that is to say, the number of collisions of packets in transmission or non-received packets, is somewhat uncorrelated with the radio signal strength. For example, the signal strength may be high but due to multi-path interference the Link Quality (bit error rate) may be low. Similarly, the RSSI may be low enough to eliminate some multi-path reflections, causing the Link Quality to be high.

Figure 6:
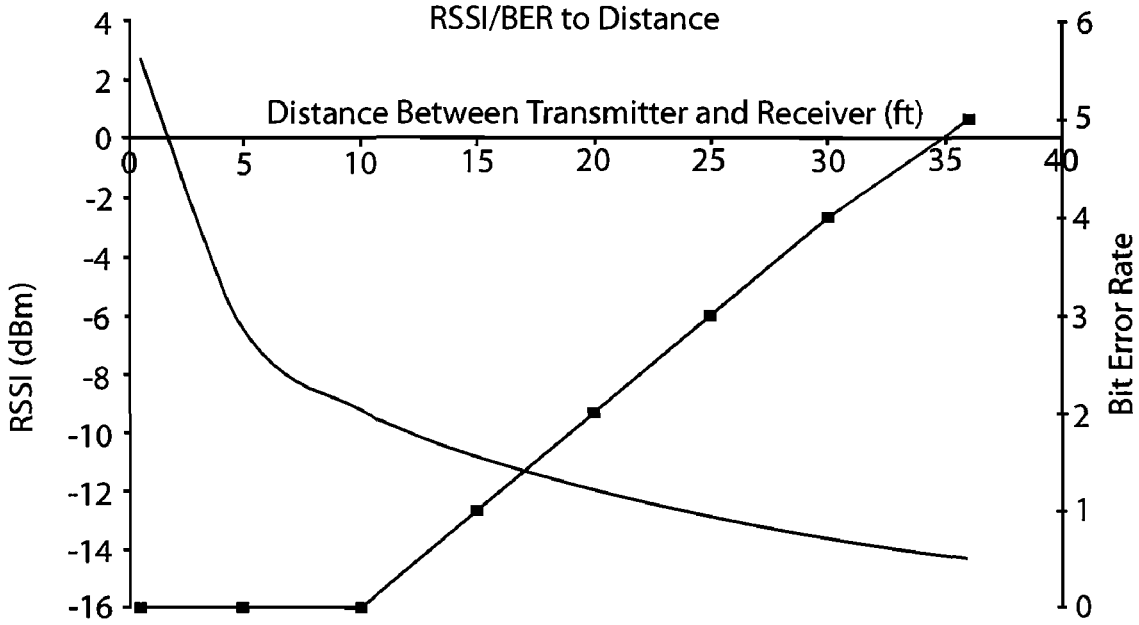
FIG. 6 shows exemplary RSSI and Bit Error rate graphs in accordance with various embodiments of the invention.
Figure 7:
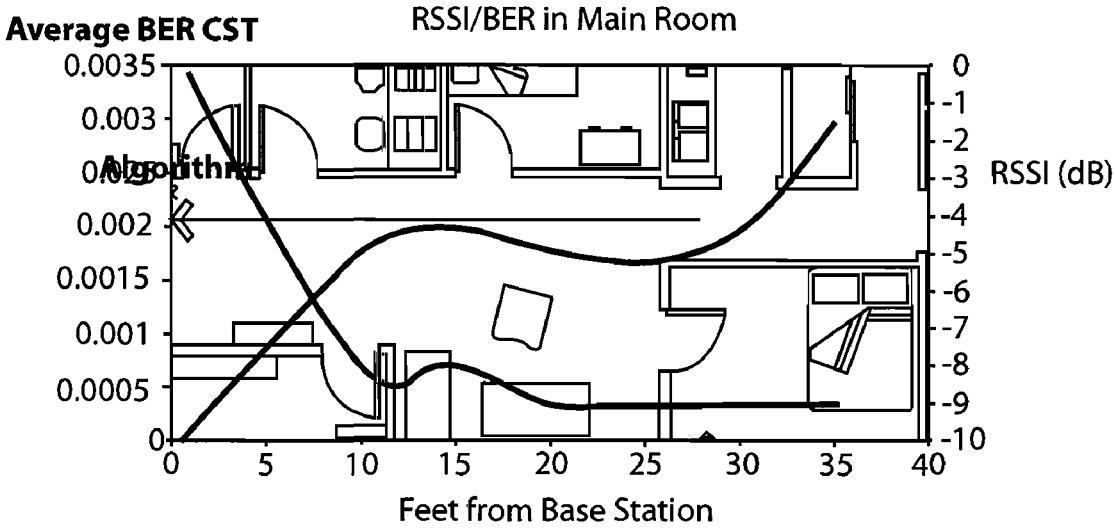
FIG. 7 shows exemplary RSSI and BER graphs as affected by physical constraints in accordance with various embodiments of the invention.
Figure 8:
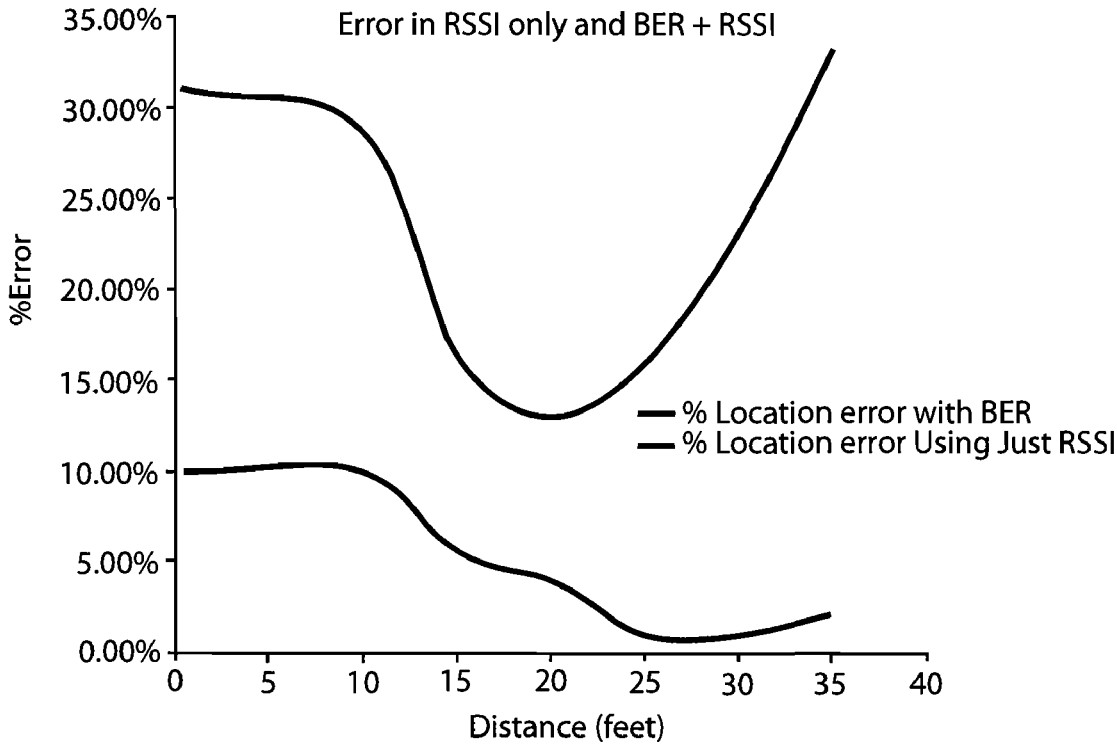
FIG. 8 shows RSSI and RSSI+BER graphs in accordance with various embodiments of the invention.

In free space or an open field, the RSSI decays to the fourth power as distance between the receiver and the medication box increases. FIG. 6 illustrates this effect. In free space, the RSSI decays to the fourth power whereas the bit error rate increases linearly as the distance increases beyond a minimum "golden" distance. FIG. 7 shows the same RSSI and BER (LQ) graphs measured in an apartment. In FIG. 7, the Bit Error Rate (BER) is less tied to the distance and more tied to multi-path issues and interference in the home due to the home's construction.

The RSSI in FIG. 7 (the line that falls from left-to-right) falls as expected and the combination of BER (Bit Error Rate) and RSSI provides the unique signature of the two walls, at 12 feet and 26 feet from the radio base station. Thus, the combination of RSSI and BER in the home can give a unique signature of the position of a signal pair transmitter and receiver.

In an embodiment, the RSSI and LQ (BER) values are read at the end of each periodic burst of communication between a base station and the user's device because those values can be read only after successful communication between the devices.

The {RSSI, LQ} pair measured at the end of a burst of communication is used to look up the corresponding physical location in a previously acquired map of the {RSSI, LQ} values for each location in the house. To create this map, the device is moved to each location within the house and the mean and standard deviation of the resulting {RSSI, LQ} values for a given physical location are recorded. According to one embodiment, the resulting map is a set of {mean RSSI, std dev RSSI, mean LQ, std LQ, physical location} entries, and the lookup algorithm finds the map entry whose distance to the measured {RSSI, LQ} value is minimum. To one skilled in the art, there exists a number of ways of determining a set of values (physical location in this case) with a set of correlated measurements (RSSI and LQ in this case).

According to various embodiments of the invention, the device may also contain a geo-locator unit to allow the position of the device, and thereby the user, to be determined, tracked and/or monitored. While this unit may involve utilize an RSSI signal as described above, it may also utilize a GPS or similar unit, or a combination thereof. Such a unit may allow the user's position to be transmitted to a remote individual such as a doctor, a relative, or other emergency services personnel. Such a feature may be desired if the individual is prone to mental lapses or to wandering off. It may also be useful if the user is experiencing an emergency and is unable to convey their location.

According to various embodiments of the invention, the device may have a biofeedback unit to measure, record, analyze and/or transmit various parameters related to the user. The parameters may include at least one of the user's pulse, blood pressure, temperature and pulse oxygen level. These parameters may be used to determine if medication should be taken prior to or independent of a time event. For example, if based on several monitored parameters, the device determines that a user is having a heart attack, the device can alert the user to take an emergency medication such as a nitroglycerin pill to minimize or prevent the heart attack. Furthermore, the device may transmit data associated with the parameters to a local computer or to a remote computer where the data can be analyzed as part of the user's medical treatment regime. The device may also be configured to alert a remote individual, possible through e-mail or voicemail, that the user is exhibiting conditions that indicate the user's medication may not be effective, or that the medication may not have been taken.

According to various embodiments of the invention, the device may have a display. The display may be used to graphically or textually relay information to the user. In some embodiments, the display may indicate which medications are to be taken by listing the medications. In the alternative, the display may show a picture image of the medication to be taken, it may display a number associated with the compartment in which the medication is located, or it may display various combinations of images and text.

According to further embodiments, a display may be used to convey information related to the user's medications, such as possible side effects or warnings associated with the medications or instructions related to the taking of the medications. For example, when a time event occurs and a user is to take a medication which should be taken with food, the display may indicate these instructions. Furthermore, if the medication contains a warning to stay out of direct sunlight or to avoid operating machinery, such warnings may also be displayed.

According to various embodiments of the invention, the display may be configured to display instruction on how or where to load medications into the device. In an alternate embodiment, such instructions may be displayed on an external monitor, such as a computer monitor that may be connected to a networked computer.

According to various embodiments of the invention, the device may have a panic button that may be configured to alert other individuals when the user is in distress. The panic button may be a button or some other form of activateable device.

According to yet further embodiments, the device may also have an audio unit which is configured to audibly convey similar instructions and/or precautions.

According to various embodiments of the invention, the device may be configured to be removably attached to a user. Such a configuration may be accomplished by having the device attached to a watchband which may be fastened to a user's wrist and then unfastened at a later time. In alternate embodiments, the device may be more securely attached to a user such that removal may require a combination or a key. Such a configuration may be useful when a user is prone to removing the device when it should not be removed, for example if the user is mentally impaired.

According to various embodiments of the invention, the device may also be removably attached to the timekeeping device. Such a configuration may be beneficial when a disposable band is used, for example a blister pack band as detailed above.

According to various embodiments of the invention, the device may utilize current pharmaceutical packaging. Medications, such as pills, may be placed in a pharmaceutically pre-filled package.

In watch 100, (see FIG. 1), the pills are placed in the band and is mounted to the watch for data gathering. The watch is set to gather data when/if the claps door is opened. It is assumed that when the door is opened the pills for that time have been taken. If the watch infers that it is past the time to take the pill, it will prompt the user accordingly. However, if the watch is aware that the pill has been taken in a timely manner, the prompt will be suppressed and the user will not be bothered with untimely reminders.

In watch 300 (see FIG. 2), a patient may carry up to a week's worth of pills in one band assuming that the user does not take a large amount of medications each day. It is also assumed that each dosage of medication will fit in each pocket of the band. The circuit runs through the doors. When the door is opened, the watch again recognizes that a door has been opened (pill has been taken) and will not prompt the user unless a pill is missed. In watch 300, the circuit passes through the dosage doors well as through the clasp.

The watch band can be replace daily or weekly depending on the amount of medication taken by the patient. Pill packs can be designed to hold multiple several pills per compartment. Although the image presented in FIG. 3 has transparent packaging, opaque packaging technology also exists an would be preferable for this usage model hiding the fact that there is medication in the band.

According to various embodiments of the invention, the device may utilize, and/or may be utilized in conjunction with, context based medication prompting. For example the device may be networked with a centralized unit, which may include a processor, such that medication reminders or events entered, stored and/or managed at the unit may also be accessed and/or altered at the device. The unit may also track different data related to a user. Accordingly, the unit and the device may be used together to obtain a more robust picture of a user's actual medication taking regimen and the user's adherence to this regimen. According to various embodiments of the invention, an additional computer interface may be used to communicate with the user's doctor and/or alternate caregivers. Data acquired and tracked using the above features may be used as a part of a larger and/or integrated home healthcare system. According to a further embodiment of the invention, a mobile device may connect to a tabletop device intended to be a tele-care system for chronic disease management. The tabletop device may be designed to help patients more easily manage their condition by helping patients keep track of their monitoring routine as well as automatically capturing, storing and/or communicating relevant information.

According to one embodiment of the invention, a patient may be provided a personal tele-care system to use in a home setting. This system may include a primary patient device as well as one or more recommended vital sign peripherals (e.g. scale, BP cuff, glucometer, etc). The system may also collect data from the peripherals as the patient uses them. If the patient's vitals signs are outside of target values for the patient, the patient may be notified and/or asked a few questions. The vital sign measurements and/or patient question and answers may be automatically aggregated and/or transferred to the clinician via a connection, such as a secure broadband or dial-up connection. The information may also used to educate the patient. The tabletop personal health system may also include an interface having a display which may be used to view various interface screens, such as screens to set medical appointments, screens to allow patients to videoconference with their doctors and screens to remind patients to take their medications.

FIG. 1 depicts an exemplary mobile medication device 100 according to various embodiments of the invention. The device 100 is shown with a timekeeping unit 101, attached to a band 102 which has a clasp 103. In the depicted embodiment, the clasp 103 may also be used as a compartment to carry medication. FIG. 2 depicts a band 202 having a clasp/medication compartment 203, power and ground converters 204 and wires 205. The power and ground converters 204 are used to form a closed circuit including the clasp/medication compartment 203. When the clasp 203 is closed, the circuit is also closed, and wire 205 is used to communicate this closed state to the timekeeping device. However, when the clasp 203 is open, as shown in the exploded view, the circuit is broken and wire 205 is used to transmit this open state to the timekeeping device.

FIG. 3 depicts a mobile medication device 300 according to further various embodiments of the invention. The device 300 is shown as having a timekeeping device 301, as well as two different types of bands, a fixed compartment band 302A and a blister pack band 302B. The fixed compartment band 302A has a plurality of compartments 306, which may be used to carry medications. The blister pack band 302B may utilize a blister pack 307 containing medications which may be preloaded at a pharmacy or a manufacturing facility. The blister pack 307, may itself make up a disposable band, or, as shown in FIG. 3, the blister pack 307 may be secured to a surface 308 of the blister pack band 302B, The surface 308 may be adhesive, such that the blister pack 307 may be struck to the surface 308.

Figure 4A:
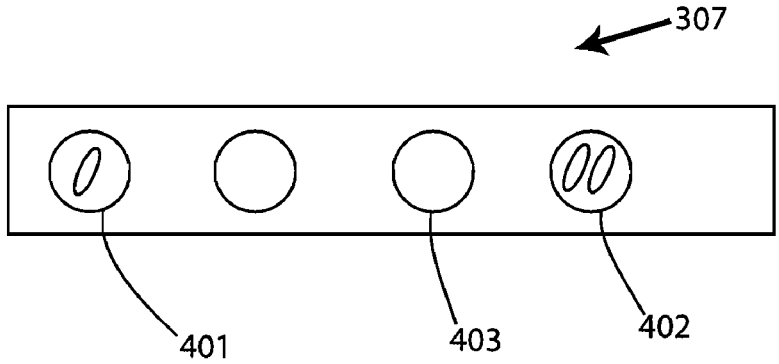
FIG. 4A depicts a top view of a blister pack band used to encapsulate medication in accordance with various embodiments of the invention.
Figure 4B:
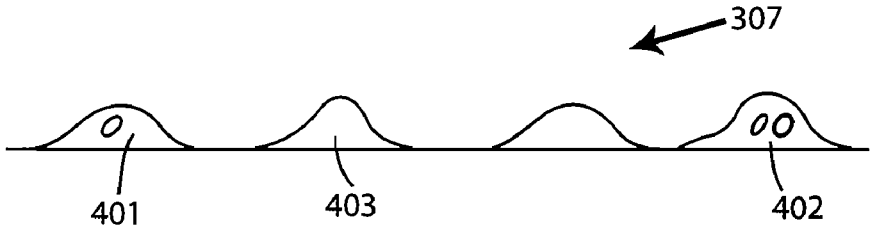
FIG. 4B depicts a side view of a blister pack band used to encapsulate medication in accordance with various embodiments of the invention.

FIG. 4A shows a top view of the blister pack 307, while FIG. 4B shows a side view of the blister pack 307. As depicted in the Figures, a compartment 401 of the blister pack 307 may encapsulate a single pill, while another of the compartments 402 may contain two or more pills, and these compartments 401, 402 may be see-through, such that the pills may be seen. Further compartments 403 may be opaque such that the encapsulated medications are not viewable. Such opaque compartments may help protect the privacy of a user as well as increase the aesthetic properties of the device.

Figure 9:
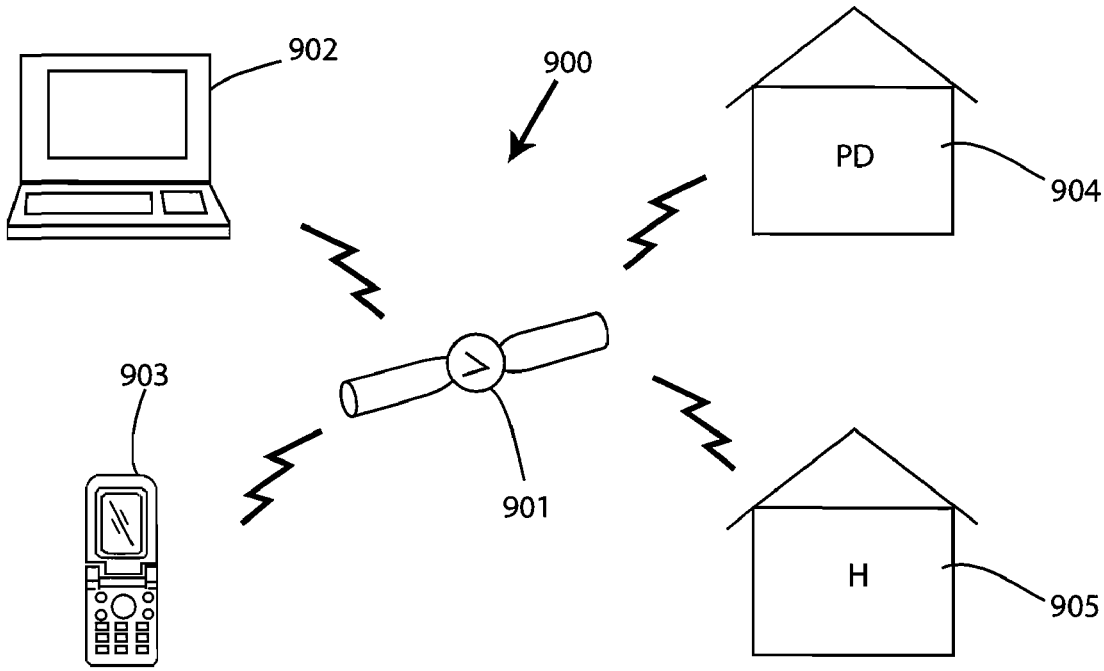
FIG. 9 depicts an exemplary mobile medication system in accordance with various embodiments of the invention.

FIG. 9 depicts a system 900 using a mobile medication device according to various embodiments of the invention. The system 900 includes a mobile medication device 901 may transfer data, wirelessly or wired, to a computer 902, a cellular phone 903, an emergency responder, such as a police department, 904, or a hospital or pharmacy 905.

We claim:

1. A mobile medication device, comprising:

a timekeeping unit to track a plurality of time events associated with a plurality of medications to be given to a user, and to alert the user based on the time events;

a band to removably attach the timekeeping unit to the user, wherein the band comprises a plurality of compartments to transport the medications;

wherein the plurality of time events comprise medication events associated with associated medications to indicate times at which the user is to be given the associated medications, wherein the associated medications are some or all of the medications that are associated with the medication events and wherein the plurality of time events further comprise pre-medication events associated with the medication events to alert the user that the medication events of the associated medications are approaching, wherein the band comprises a clasp and the clasp comprises a one or more of the plurality of compartments to transport the medications.

2. The device of claim 1, further comprising a medication tracking unit to track the medications being transported in the compartments.

3. The device of claim 2, wherein the medication tracking unit is configured to determine that at least one of the medications is no longer being transported.

4. The device of claim 2, wherein at least one of the compartments comprises a locking unit to prevent the compartment from being opened, wherein the locking unit is configured to be disabled when a time event associated with the compartment occurs.

5. The device of claim 4, wherein the time event associated with the compartment is a medication event.

6. The device of claim 2, wherein the timekeeping unit comprises a display to indicate which of the plurality of medications is to be given to the user based upon at least one of the time events.

7. The device of claim 6, wherein the display is configured to display images associated with the medications to be given.

8. The device of claim 2, further comprising an audio alert device configured to emit an audio signal when a predetermined time event has occurred.

9. The device of claim 8, wherein the audio signal indicates which of the medications are to be given.

10. The device of claim 8, further comprising a visual alert device configured to emit a visibly detectable signal when a predetermined time event has occurred.

11. The device of claim 2, further comprising a visual alert device configured to emit a visibly detectable signal when a predetermined time event has occurred.

12. The device of claim 2, further comprising a plurality of visual alert devices associated with the plurality of compartments and configured to emit a visibly detectable signal when a predetermined time event has occurred.

13. The device of claim 12, wherein the visibly detectable signals are configured to illuminate the compartments associated with the time events.

14. The device of claim 2, further comprising a motion based alert device configured to cause the device to vibrate when a predetermined time event has occurred.

15. The device of claim 2, wherein the timekeeping unit comprises a memory.

16. The device of claim 15, wherein at least one prescription associated with at least one of the medications is stored in the memory.

17. The device of claim 2, wherein the timekeeping unit is configured to be programmed using an external computer.

18. The device of claim 17, wherein the external computer transmits data to the timekeeping using Bluetooth technology.

19. The device of claim 2, further comprising a biofeedback unit to measure at least one of the user's pulse, blood pressure, temperature and pulse oxygen level.

20. The device of claim 2, further comprising a transmitter to transmit data to an external processor.

21. The device of claim 2, further comprising a geo-locator unit to determine a relative position of the device.

22. The device of claim 21, wherein the geo-locator unit comprises a GPS device.

23. The device of claim 21, wherein the geo-locator unit utilizes RSSI.

24. The device of claim 1, wherein the plurality of time events further comprise post-medication events, associated with the medication events, to alert the user that the associated medication events have passed.

25. The device of claim 24, wherein the compartments comprise blister packs and wherein the medication tracking unit is configured to determine that at least one of the medications is no longer being transported due to a change in a conductivity of the associated blister pack.

26. A medication reminder system, comprising:

a mobile medication device, comprising:

a timekeeping unit to track a plurality of time events associated with a plurality of medications to be given to the user, and to alert the user based on the time events; and a band comprising a clasp to removably attach the timekeeping unit to the user, wherein the band comprises a plurality of compartments to transport the medications and an electronic circuit that passes though the compartments and the clasp, the electronic circuit adapted to monitor when the compartments are opened; and an external microprocessor device to transfer data to and from the timekeeping unit.

27. A mobile medication device, comprising:

a timekeeping unit to track a plurality of time events associated with a plurality of medications to be given to a user, and to alert the user based on the time events; and a band to removably attach the timekeeping unit to the user, wherein the band comprises a first band type and a second band type, wherein the first band type comprises a plurality of fixed compartments to transport the medications and the second band type includes a blister pack to transport the medications.

28. The mobile medication device of claim 27, wherein the plurality of time events comprise medication events associated with associated medications to indicate times at which the user is to be given the associated medications, wherein the associated medications are some or all of the medications that are associated with the medication events and wherein the plurality of time events further comprise pre-medication events associated with the medication events to alert the user that the medication events of the associated medications are approaching.

* * * * *